US005309948A

United States Patent [19]

Banba

[11] Patent Number: 5,309,948

[45] Date of Patent: May 10, 1994

[54] APPARATUS FOR REPLACING FULL CLOTH ROLL ON WEAVING MACHINE WITH EMPTY CLOTH ROLL

[75] Inventor: Hideki Banba, Ishikawa, Japan

[73] Assignee: Tsudakoma Kogyo Kabushiki Kaisha, Ishikawa, Japan

[21] Appl. No.: 52,126

[22] Filed: Apr. 22, 1993

[30] Foreign Application Priority Data

Apr. 27, 1992 [JP] Japan ..... 4-131441

[51] Int. Cl.[5] ..... D03D 49/20

[52] U.S. Cl. ..... 139/1 R; 139/291 C

[58] Field of Search ..... 242/58.3, 66, 56 R, 242/58, 58.1-58.5; 28/201, 208; 139/1 R, 291 R, 291 C

[56] References Cited

U.S. PATENT DOCUMENTS 5,063,970 11/1971 Tanaka et al. .
5,146,954 9/1992 Ostyn et al. ..... 139/1 R
5,197,521 3/1993 Graser et al. ..... 139/1 R
5,224,518 7/1993 Lefever et al. ..... 139/1 R

FOREIGN PATENT DOCUMENTS 1-97241 3/1989 Japan .

*Primary Examiner*—Andrew M. Falik
*Attorney, Agent, or Firm*—Graybeal Jackson Haley & Johnson

[57] ABSTRACT

An apparatus for replacing a full cloth roll loaded on a pair of rollers of a weaving machine with an empty cloth roll, which apparatus includes a pair of oscillating members supported by the weaving machine to oscillate about an axis of a rod supported by the weaving machine and cylinders for having both the oscillating members to produce oscillating movement. Each oscillating member includes a contact portion exerting a pressing force to the full cloth roll to roll the full cloth roll while both the oscillating members are oscillating in one direction. Each oscillating member further includes a guide wall disposed behind the contact portion for catching the empty cloth roll in cooperation with the peripheral surface of the textile of the full cloth roll, and for directing, during the oscillating movement of both the oscillating members, the empty cloth roll to the upper position right above both the rollers in cooperation with the peripheral surface of the textile of the full cloth roll.

3 Claims, 11 Drawing Sheets

APPARATUS FOR REPLACING FULL CLOTH ROLL ON WEAVING MACHINE WITH EMPTY CLOTH ROLL

BACKGROUND OF THE INVENTION

1. Field of the Invention

This invention relates to an exchange apparatus for exchanging a full cloth roll with a textile wound therearound for an empty cloth roll.

2. Description of the Prior Art

There is such a weaving machine as provided in its lower position with an exchange apparatus for exchanging a full cloth roll loaded on a pair of rollers for an empty cloth roll disposed at its upper position (See Japanese Patent Public Disclosure (KOKAI) No. 1-97241 and U.S. Pat. No. 5,063,970).

These exchange apparatuses consist of a reciprocating member for exerting pressing force to both end portions of the full cloth roll on the pair of rollers to deliver the full cloth roll onto a receiving table in front of the weaving machine, and a carrying device for carrying the empty cloth roll from a neighborhood of the position where the empty cloth roll is disposed to a neighborhood above the pair of rollers and then releasing the carried empty cloth roll onto the rollers.

The carrying device described in Japanese Patent Public Disclosure No. 1-97241 consists of a pair of elevating members each having an opening capable of receiving each end portion of the empty cloth roll, and a vertical guide covering the opening during elevating movement of the elevating member. After receiving in its opening the end portion of the empty cloth roll released from the position where the empty cloth roll is disposed at the highest position that the opening of the elevating member is not covered by the vertical guide, the elevating member descends down to the lowest position. During its descent, the each end portion of the empty cloth roll is held by the elevating member, since the opening of the elevating member is covered by the vertical guide. When the opening of the elevating member reaches the lowest position that the opening is not covered by the vertical guide, the empty cloth roll rolls down at a low speed onto the pair of rollers after the end portion thereof passes through the opening.

Also, the carrying device described in U.S. Pat. No. 5,063,970 consists of a damper arm which has one end portion supported oscillatably and provided with a receiving board for loading the empty cloth roll and which oscillates due to the empty weight of the empty cloth roll when the empty cloth roll is loaded on the receiving board, and a cam member fixed on a reciprocating (oscillating) member for regulating the oscillating movement of the damper arm.

When the oscillating member is oscillated forward and the full cloth roll is delivered onto the receiving table, the empty cloth roll released from its loading position is received for the time being by the receiving board of the damper arm waiting in the upper position. Though the damper arm which received the empty cloth roll would oscillate due to the empty weight of the empty cloth roll, the oscillating movement is prevented by the cam member of the oscillating member in the course of moving forward. Subsequently, when the oscillating member is oscillated in the opposite direction, the damper arm gradually oscillates along the cam surface, and when the cloth roll also gradually descends and reaches a neighborhood of the pair of rollers, the inclination of the receiving board becomes steep, so that the empty cloth roll drops from the receiving board onto the pair of rollers.

The vertical guide of the carrying device described in Japanese Patent Public Disclosure No. 1-97241is also used as the reciprocating member for delivering the full cloth roll, but it is difficult to make the exchange apparatus compact, because of the necessity for the elevating member and its drive member.

Also, in the carrying device described in U.S. Pat. No. 5,063,970, the damper arm is made to oscillate by the empty weight of the empty cloth roll because it dispenses with a drive member specific to drive the damper arm. However, since no measures are taken to prevent the empty cloth roll from falling down from the receiving board, it has such a defect as to fall down by vibration or the like before reaching a position right above the pair of rollers. Further, it requires a space for disposing the damper arm, besides that for disposing the oscillating member.

SUMMARY OF THE INVENTION

An object of the present invention is to provide, in light of the defects of foregoing prior art apparatuses, an apparatus for dropping an empty cloth roll surely on a pair of rollers, without taking a space, by sharing a drive member between a carrying device and an oscillating member.

The apparatus of the present invention can move the empty cloth roll slowly toward the pair of rollers, utilizing the peripheral surface of a textile on the full cloth roll delivered onto the receiving table and the guide walls of the oscillating members as the guides.

When released from its location, the empty cloth roll is caught by the peripheral surface of the textile and the guide walls. By oscillating the oscillating members and rolling the full cloth roll from above the pair of rollers, the peripheral surface of the textile on the full cloth roll and the guide walls in cooperation with each other direct the empty cloth roll downward and release it onto the pair of rollers during or after rolling of the full cloth roll. The distance between the extension of the peripheral surface of the textile on the full cloth roll and the guide walls of the oscillating members is preferably set to gradually decrease downward.

Thus, the empty cloth roll is bound by the guide walls of the oscillating members and the peripheral surface of the textile on the full cloth roll until positioned on the pair of rollers, so that delivery of the empty cloth roll onto the pair of rollers is ensured.

According to the present invention, the pair of oscillating members act for both guiding the empty cloth roll and pressing the full cloth roll. As a result, the structure of the exchange apparatus is simple and compact on the whole, compared with the prior art apparatuses in which the two pairs of members are made to take both such actions respectively.

It is possible to direct the empty cloth roll from its support position to the gap between the guide walls of the oscillating members and the peripheral surface of the textile on the full cloth roll, by providing in the oscillating members a push-up portion for exerting a push-up force to the end portions of the empty cloth roll disposed in an upper position during oscillating.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
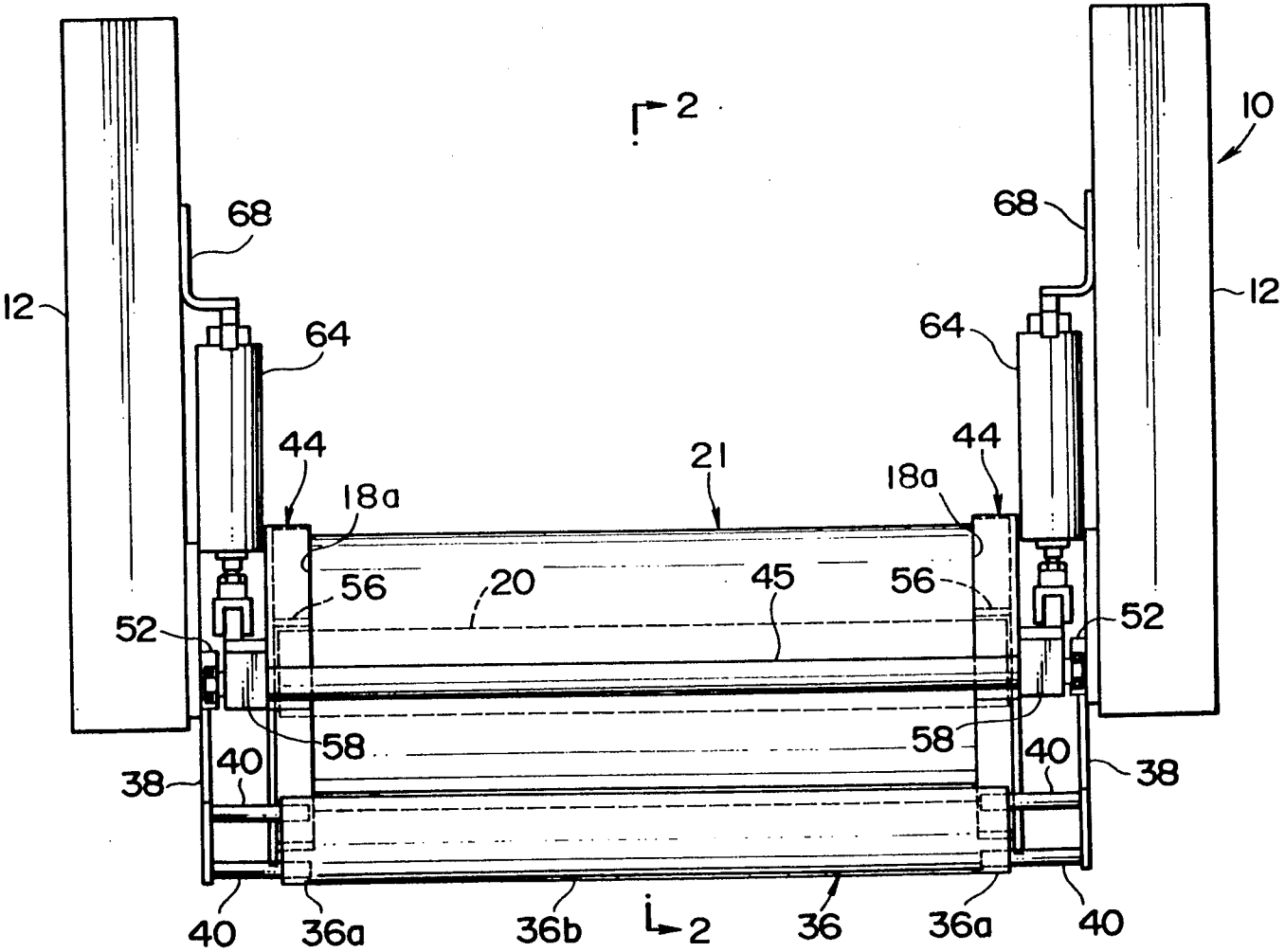
FIG. 1 is a schematic plan view showing a cloth roll exchange apparatus as a preferred embodiment of the present invention.
Figure 2:
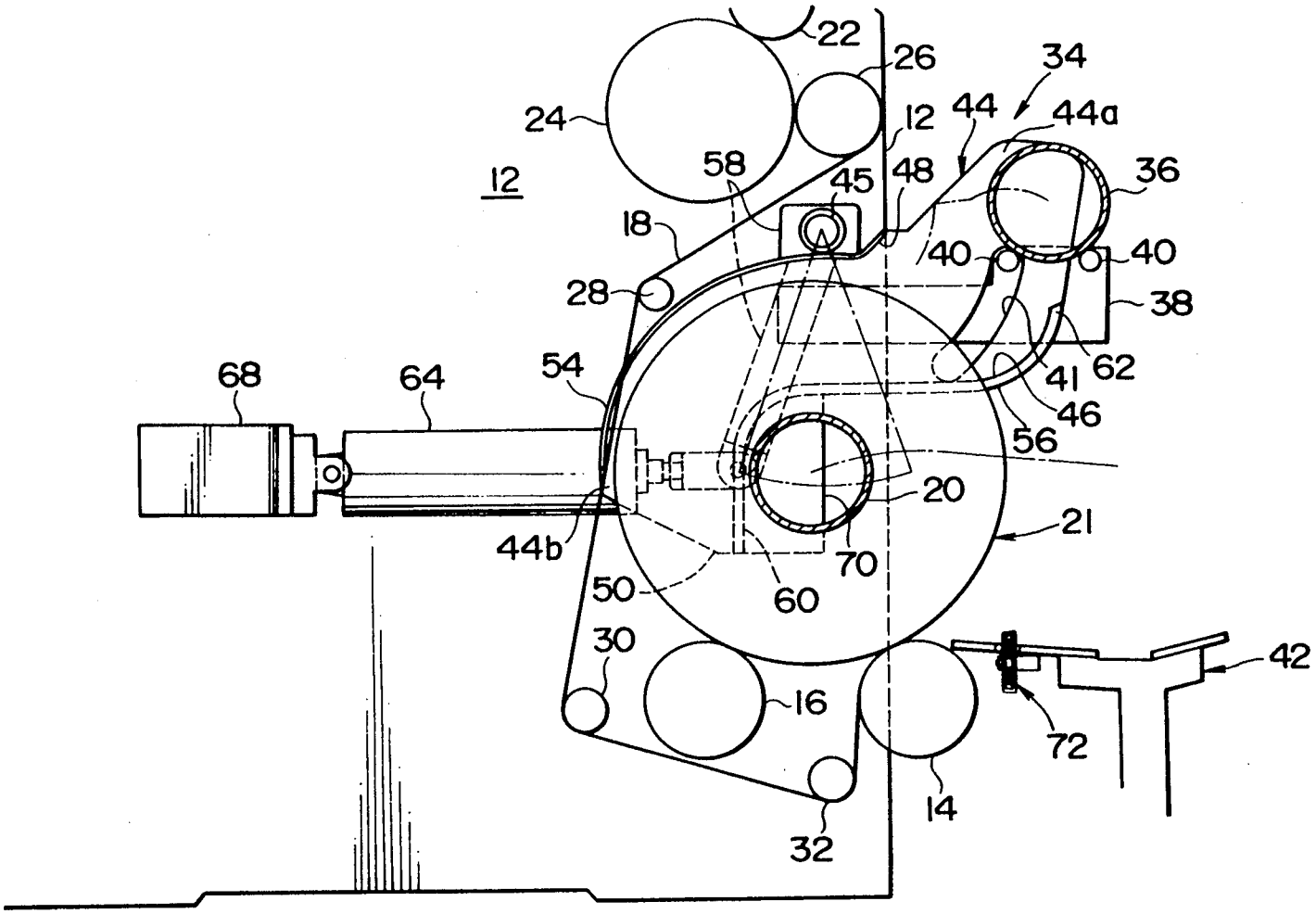
FIG. 2 is a vertical sectional view taken along a line 2—2 in FIG. 1 where hatching for a roller and a shaft member is omitted for simplicity.

Referring now to FIGS. 1 and 2, numeral 10 indicates a weaving machine and a pair of parallel rollers 14 and 16 are provided at an interval in the longitudinal direction and rotatably supported to the lower portion of a pair of mutually parallel frames 12 which define the front portion (right side in FIG. 2) of the weaving machine 10.

A cloth roll 20 rolled with a textile 18 woven by a weaving portion (not shown) at the rear portion (left side in FIG. 2) of the weaving machine 10 is loaded on both rollers 14 and 16 in parallel to both rollers 14 and 16. At least one of both rollers 14 and 16 is driven and rotated around its axis to rotate the cloth roll 20 loaded on both rollers. The textile 18 circulating in turn around a plurality of other rollers 22 through 32 and the roller 14 which are rotatably supported by both frames 12 is rolled up by the rotating cloth roll 20.

A cloth roll 21, i.e., a full cloth roll, rolling up the textile 18 having a predetermined length around the cloth roll 20 is exchanged with an empty cloth roll 36, which is a new cloth roll with no textile wound therearound, through an exchange apparatus 34 described later.

The empty cloth roll 36 is provided at a position above the full cloth roll 21 and in parallel to the full cloth roll. In more detail, the empty cloth roll 36 is loaded on two pairs of pins 40 at both ends thereof. The two pairs of pins 40 extend in parallel to the rollers 14 and 16 and are supported in a cantilever fashion by a pair of arms 38 extending forwardly from the front ends of both frames 12.

The exchange of the cloth roll is carried out by transferring the full cloth roll 21 from a pair of rollers 14 and 16 to a receiving table 42 provided in front of the weaving machine 10 and by loading the empty cloth roll 36 on both rollers 14 and 16. The receiving table 42 is located at a position in close proximity to the front roller 14.

The cloth roll exchange apparatus 34 comprises a pair of oscillating members 44. Each oscillating member 44 is fixed in the neighborhood of each end of the rod 45 extending in parallel to both rollers 14, 16 rotatably supported by both frames 12, and thereby each oscillating member 44 is oscillatably supported by each frame 12. When both oscillating members 44 are oscillated around the axis of the rod 45 as described in detail later, the full cloth roll 21 is transferred toward the receiving table 42 and the empty cloth roll 36 is guided onto a pair of rollers 14 and 16.

Each illustrated oscillating member 44 extends so as to be curved in a S-letter shape as a whole, and in FIG. 2, one end (upper end) 44*a* of each oscillating member partially faces the end face of the empty cloth roll 36. One of each pair of pins 40 for supporting the empty cloth roll 36 is provided in front of the upper end 44*a* of the oscillating member 44, and the other pin is passed through an arcuate slot 41 provided with the upper end 44*a* of the oscillating member 44. When pressing force is exerted rearward to the empty cloth roll 36, the empty cloth roll 36 can be dropped toward the other end (lower end) 44*b* of the oscillating member 44.

The lower end 44*b* of the oscillating member is provided at the rear of the cloth roll 20 and located above the roller 16, as shown in FIG. 2.

Both oscillating members 44 have respectively guide grooves 46 for guiding the empty cloth roll 36, and both guide grooves 46 are opened to face each other. Each guide groove 46 extends along a portion of each oscillating member in a curved form from the upper end 44*a* and terminates at the lower end 44*b* of the oscillating member.

Each guide groove 46 has a width slightly larger than the outer diameter of the empty cloth roll 36*a*, and includes an upper end 48 for accepting each end 36*a* of the empty cloth roll 36 and a lower end 50 for permitting the release of each end 36*a* of the empty cloth roll. When the oscillating member 44 is oscillated counterclockwise in FIG. 2, the lower end 50 of the guide groove 46 is moved from the upper position of the roller 16 to the upper position of the roller 14 so as to cross over these rollers.

When the empty cloth roll 36 is dropped from both pins 40, the guide groove 46 partially faces to the upper portion of the end face (selvage) 18*a* of the textile of the full cloth roll 20 on a pair of rollers 14 and 16. From this reason, the distance between the extension of the peripheral surface of the textile on the cloth roll 20 in the axial direction and an upper wall 54 (described later) defining the guide groove 46 is smaller than the outer diameter of the empty cloth roll 36. Therefore, when the empty cloth roll 36 is dropped from both pins 40, the empty cloth roll 36 is brought into contact at its both ends 36*a* with the upper walls 54 and at its intermediate portion 36*b* between both ends 36*a* of the empty cloth roll with the peripheral surface (textile surface) of the full cloth roll 21, thereby the empty cloth roll 36 is supported.

The rod 45 defining the oscillating axis of each oscillating member 44 is located above the full cloth roll 21. The axis of the rod 45 is positioned slightly ahead of the axis of the full cloth roll 21. Both ends of the rod 45 are rotatably supported by both frames 12 through a pair of bearings 52.

The rod 45 passes through an end of a lever 58 fixed to the upper wall (the first guide wall) 54 out of a pair of upper and lower walls 54 and 56 defining the guide groove 46 and is fixed to the end of the lever 58. The lever 58 crosses over approximately at the center of the oscillating member 44 in the extending direction and extends downward.

In the illustrated embodiment, the upper wall 54 defining the guide groove 46 has a portion curved at the curvature approximately equal to the curvature of the outermost periphery of the textile 18 on the full cloth roll 21, and the lower wall (the second guide wall) 56 has a portion curved at the curvature approximately equal to the curvature of the cloth roll 20.

Each oscillating member 44 has a contact portion 60 capable of contacting each end of the cloth roll 20. In the illustrated embodiment, the lower end of the lower wall 56 defining the guide groove 46 defines the contact portion 60. When the cloth roll 20 is placed on a pair of rollers 14 and 16 ready to be wound, the contact portion 60 is maintained in a non-contact state relative to each end of the cloth roll 20 so as prevent any disturbance of the rotation of the cloth roll 20. Furthermore, the upper end of the lower wall 56 defines a push-up portion 62 for exerting push-up force to the end 36*a* of the empty cloth roll 36 when the oscillating member 44 is oscillated counterclockwise.

Drive means, i.e., an air cylinder in the illustrated embodiment is provided to allow each oscillating member 44 to do the oscillating movement. Each air cylinder 64 extends in the longitudinal direction and one end thereof (front end) is pivoted to the lower end of the lever 58, and the other end (rear end) is pivoted oscillatably to the weaving machine 10 through a pivotal bracket 68.

Figure 3:
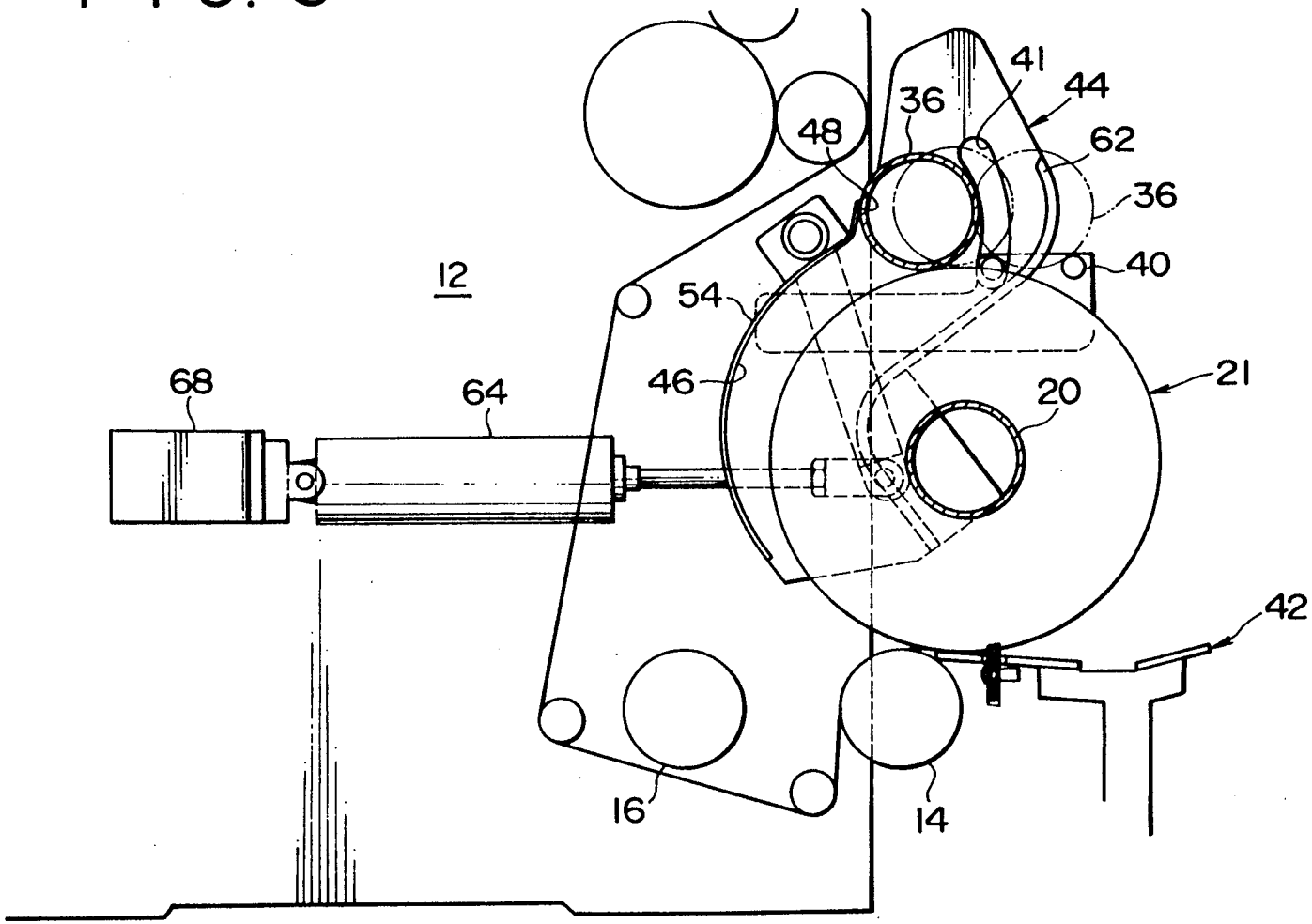
FIG. 3 is a vertical sectional view showing the cloth roll exchange apparatus shown in FIG. 1 under the condition that a full cloth roll arrives at the rear end of a receiving table.
Figure 4A:
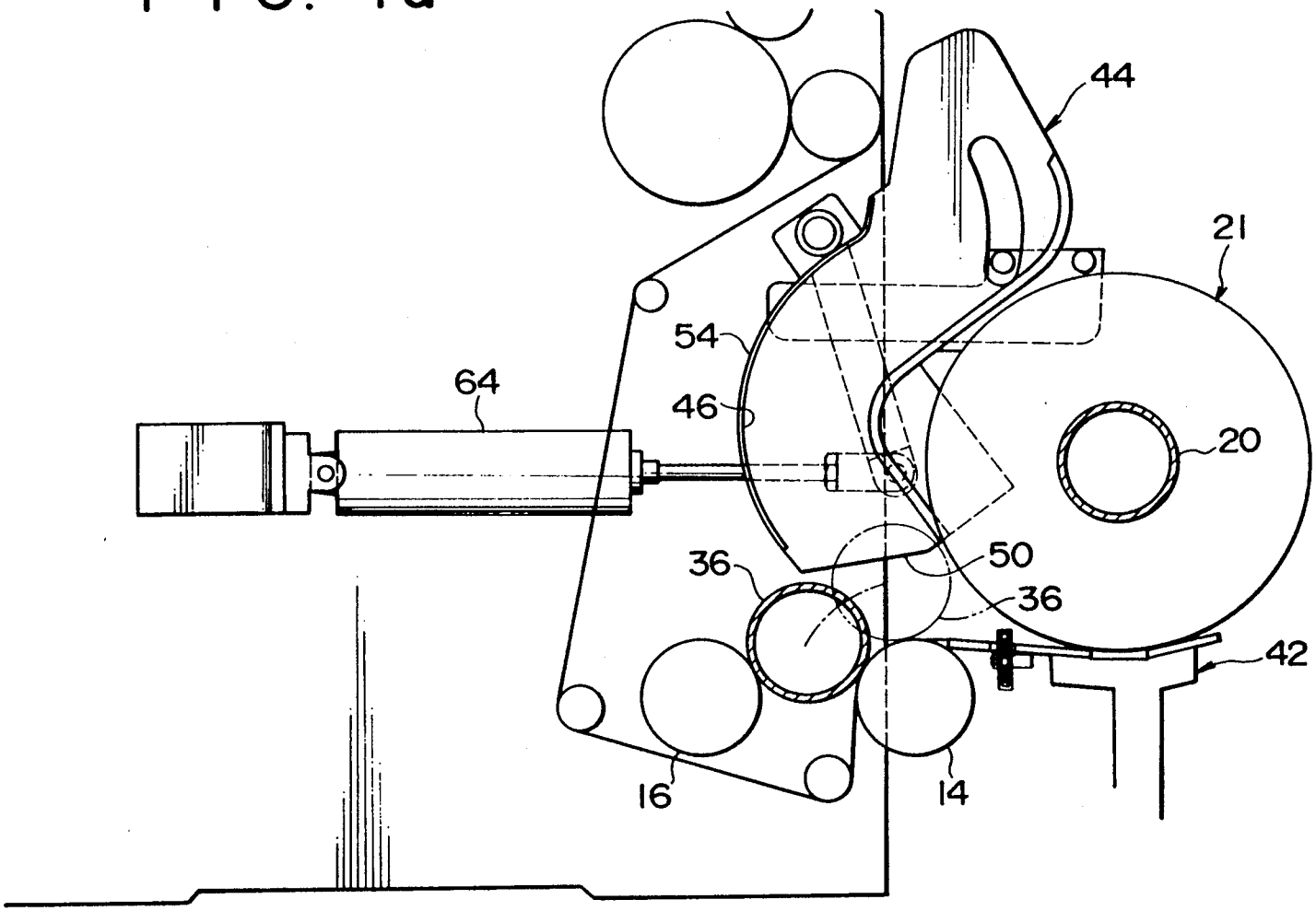
FIG. 4*a* is a vertical sectional view showing the cloth roll exchange apparatus shown in FIG. 1 under the condition that the full cloth roll arrives at the center of the receiving table.

When the air cylinder 64 is operated to extend so as to oscillate the oscillating member 44 counterclockwise together with the lever 58 from the condition shown in FIG. 2, the contact portion 60 of each oscillating member contacts each end of the cloth roll 20 to exert a pressing force to the cloth roll 20, and causes the full cloth roll to roll toward the receiving table 42 (FIGS. 3 and 4*a*). The resulting rolling locus is shown by one-dotted chain line. On the other hand, the push-up portion 62 during the oscillating movement counterclockwise strikes against each end of the empty cloth roll 36 through the gap between a pair of pins 40. Incidentally, since the slot 41 is of a circular shape with the rod 45 as its center, the pin 40 in the rearward does not hinder this oscillating movement. As a result, the empty cloth roll 36 is rolled and dropped from two pairs of pins 40, and each end 36*a* enters the guide groove 46 of each oscillating member 44 from its upper end 48. The resulting locus of the axis of the empty cloth roll 36 during this time is shown by one-dotted chain line.

As shown in FIG. 3, the oscillating movement of the oscillating member 44 is carried out until the full cloth roll 21 is loaded on the rear end of the receiving table 42. In the illustrated embodiment, since the rear end of the receiving table 42 descends forward, the full cloth roll 21 subsequently rolls forwardly on the receiving table 42 to the center portion of the receiving table 42. As described above, the oscillating range of the oscillating member 44, a part of the movement locus of the empty cloth roll 36 and the movement locus of the full cloth roll 21 are shown by one-dotted chain lines in FIG. 2, respectively.

While the full cloth roll 21 is moved to the center portion of the receiving table 42, the distance between the extension of the peripheral surface of the full cloth roll 21 in the axial direction and the upper wall 54 of the oscillating member is gradually increased. Therefore, each end 36*a* of the empty cloth roll 36 is slowly descended within the guide groove 46 of each oscillating member 44, while the intermediate portion 36*b* of the empty cloth roll 36 contacts the peripheral surface of the full cloth roll, i.e., the surface of the textile.

As shown in FIG. 4*a*, when the full cloth roll 21 reaches the center of the receiving table 42, the distance between the extension of the peripheral surface of the textile 18 on the cloth roll and the upper wall 54 defining the guide groove 46 becomes larger than the outer diameters of the empty cloth roll 36. As a result, the end 36*a* of the empty cloth roll 36 is released from the lower end 50 of the guide groove 46, and the empty cloth roll 36 is dropped onto the front roller 14. Subsequently, the empty cloth roll is moved to the gap between both rollers 14 and 16. Thereafter, the air cylinder 64 is operated to shorten, and the oscillating member 44 is oscillated clockwise (in the other direction) to return to its former position. The lower wall 56 is set to have a dimension such that its lower end does not come into contact with the empty cloth roll 36 at that time.

Figure 4B:
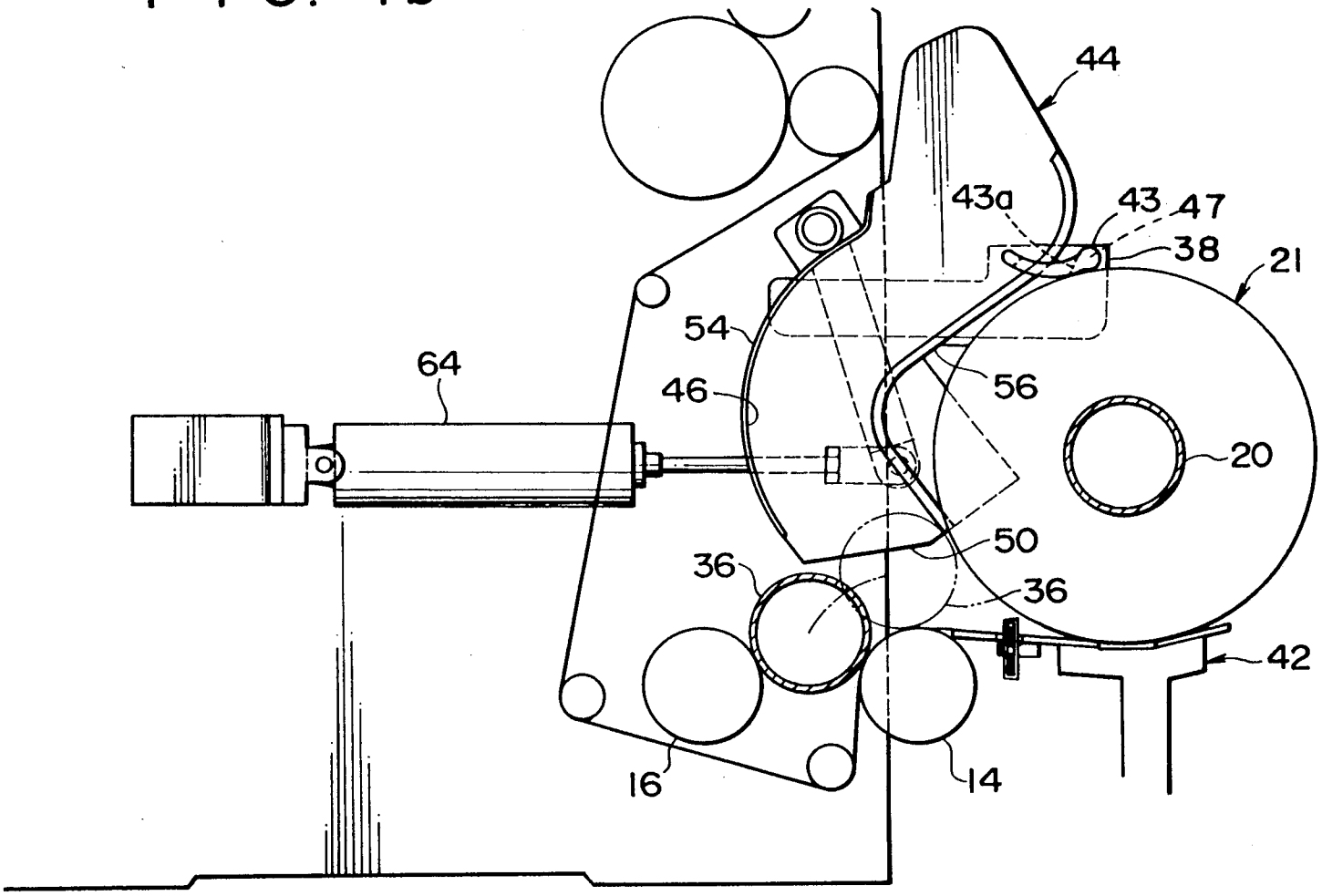
FIG. 4*b* is a vertical sectional view similar to FIG. 4*a*, showing a cloth roll exchange apparatus under the condition that an empty cloth roll is supported by a receiving member, not by pins.

Also, in place of both pins 40, it is possible, as shown in FIG. 4*b*, to make a circular supporting member 43 capable of loading the end portion of the empty cloth roll to be supported by a support member 47 projecting from the arm 38, and further, to provide a notch 43*a* for permitting the upper portion of the lower wall 56 to move while the oscillating members 44 are oscillating. This dispenses with forming of the slot 41 in the oscillating member 44.

Figure 5:
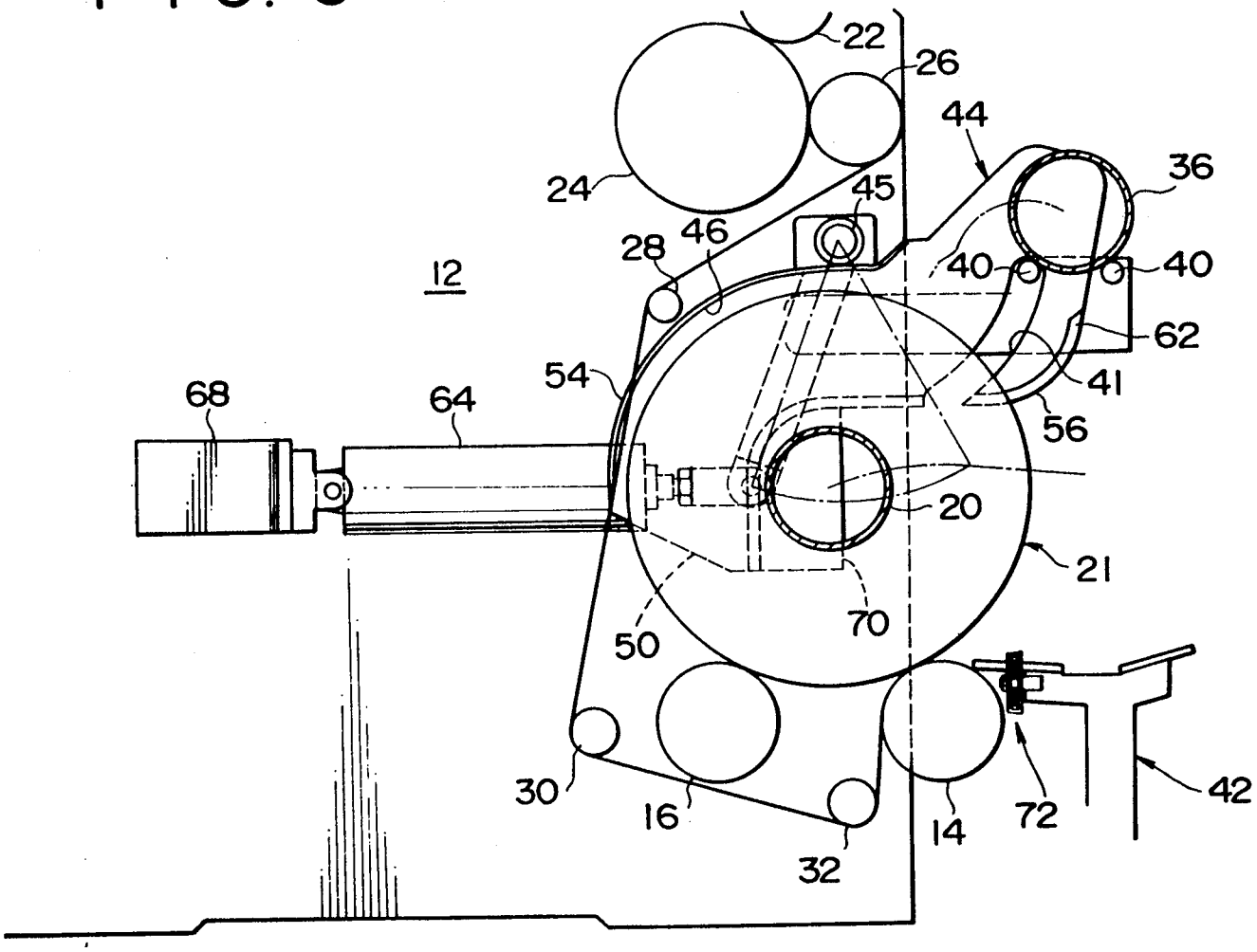
FIG. 5 is a vertical sectional view showing a partially modified cloth roll exchange apparatus under the condition that a full cloth roll is positioned on a pair of rollers as another preferred embodiment of the present invention.
Figure 6:
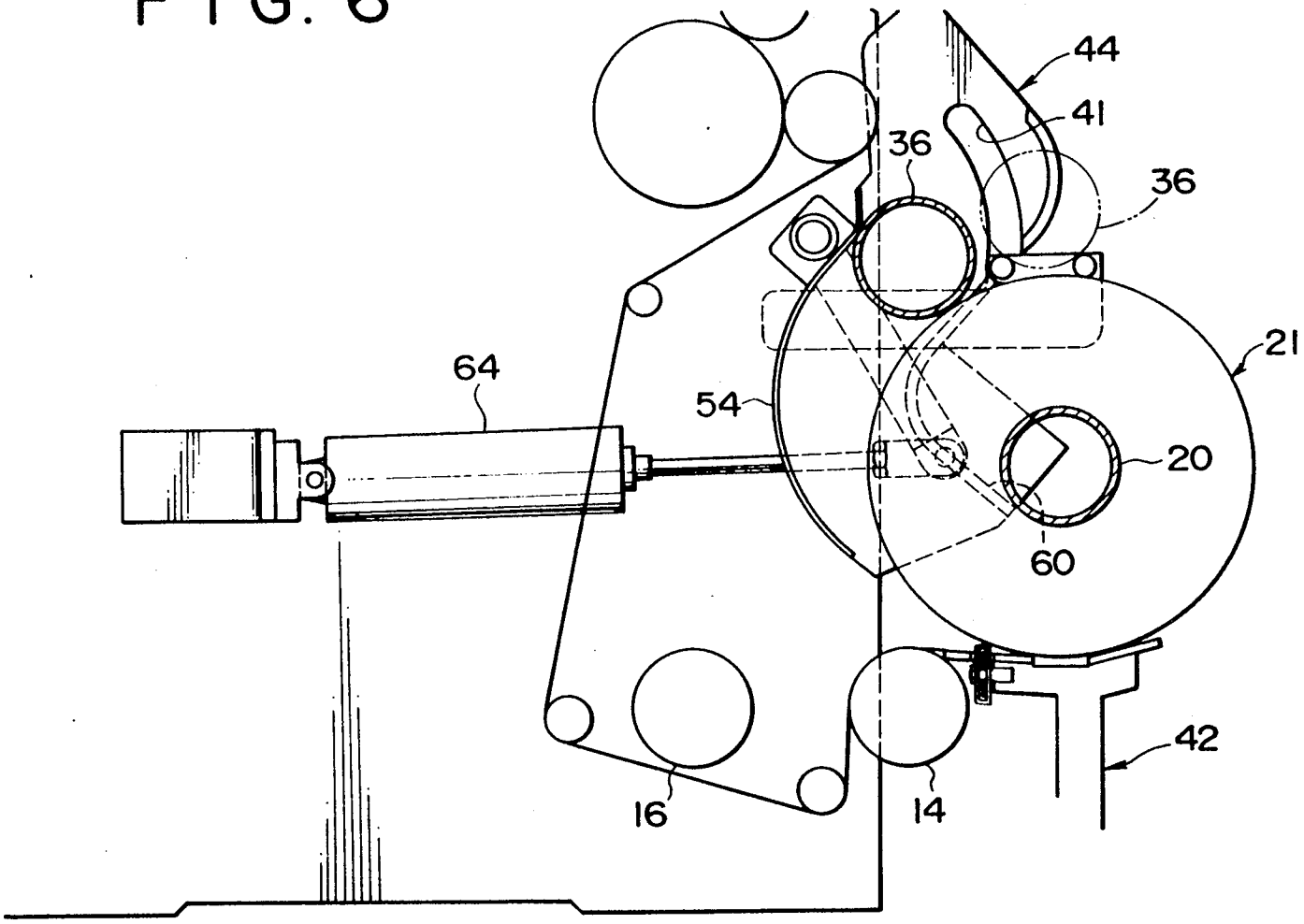
FIG. 6 is a vertical sectional view showing the cloth roll exchange apparatus shown in FIG. 5 under the condition that the full cloth roll arrives at the center of the receiving table.
Figure 7:
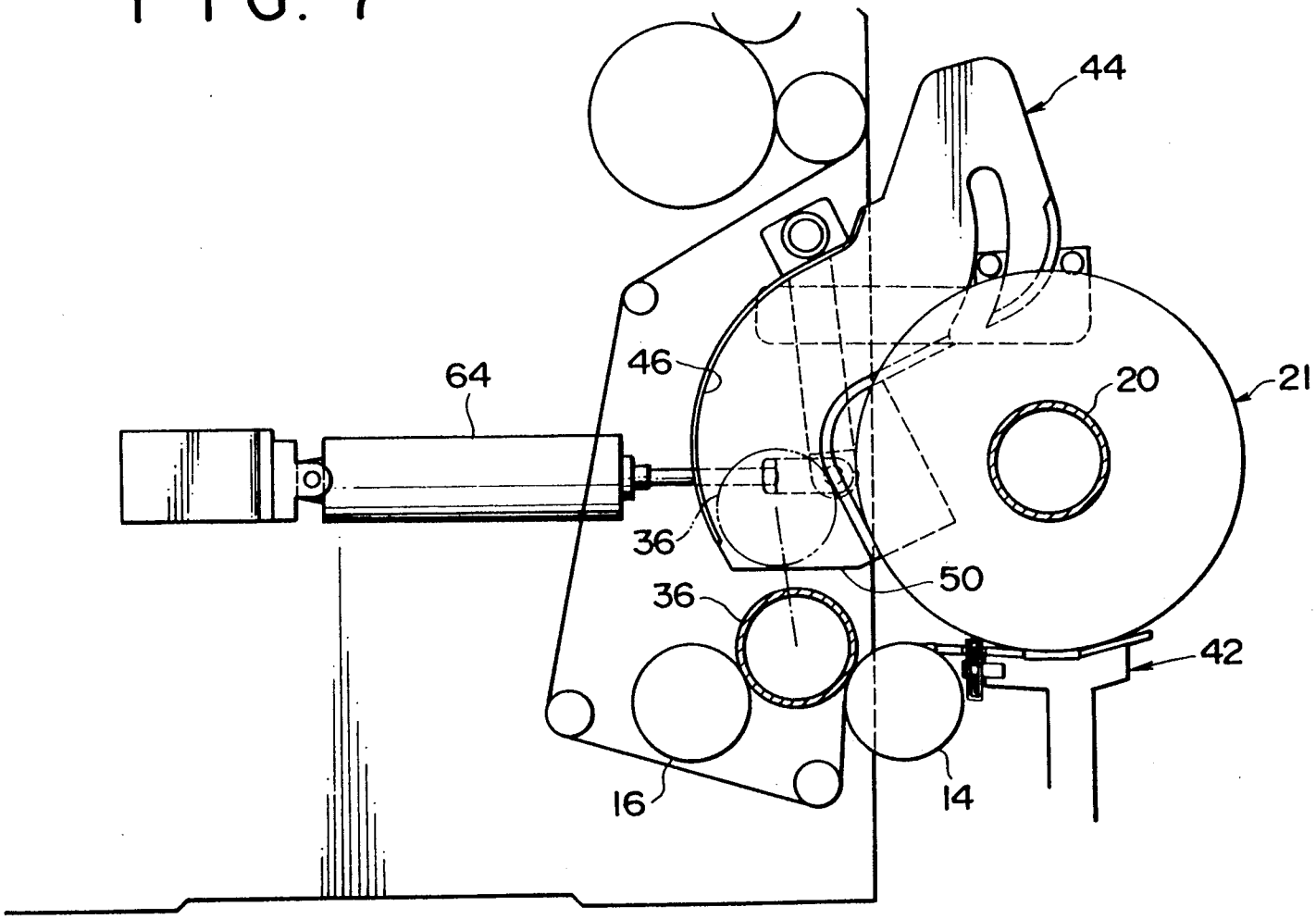
FIG. 7 is a vertical sectional view showing the cloth roll exchange apparatus shown in FIG. 5 under the condition that the oscillating member is oscillated in the reverse direction.

Referring now to FIGS. 5 through 7 which show the second embodiment, the lower end of the slot 41 of the oscillating member 44 for permitting the relative movement of the rear pin 40 for supporting the empty cloth roll 36 is set as an opened end which is made by cutting out a portion of the lower wall 56 defining the guide groove 46. Accordingly, the oscillatable range (refer to one-dotted chain line shown in FIG. 5) of the oscillating member 44 is larger than that of the embodiment shown in FIGS. 1 through 4*b*.

In this embodiment, the air cylinder 64 is actuated until the full cloth roll 21 reaches the center portion of the receiving table 42 from the condition of FIG. 5 showing the condition similar to that of FIG. 2 to maintain the condition of contact between the contact portion 60 of the oscillating member and the end of the cloth roll 20 (FIG. 6). Therefore, during this time, the distance between the extension of the peripheral surface of the full cloth roll 21 in the axial direction and the upper wall 54 of the oscillating member 44 varies, though not to such an extent as to drop the empty cloth roll 36 downward (FIG. 6). Thereafter, as shown in FIG. 7, when the air cylinder 64 is operated to shorten to allow the oscillating member 44 to oscillate in the opposite direction, the lower end 50 of the guide groove 46 reaches the upper position between both rollers 14 and 16. At that time, the distance described above becomes larger and the empty cloth roll 36 is slowly dropped between both rollers 14 and 16.

Figure 8:
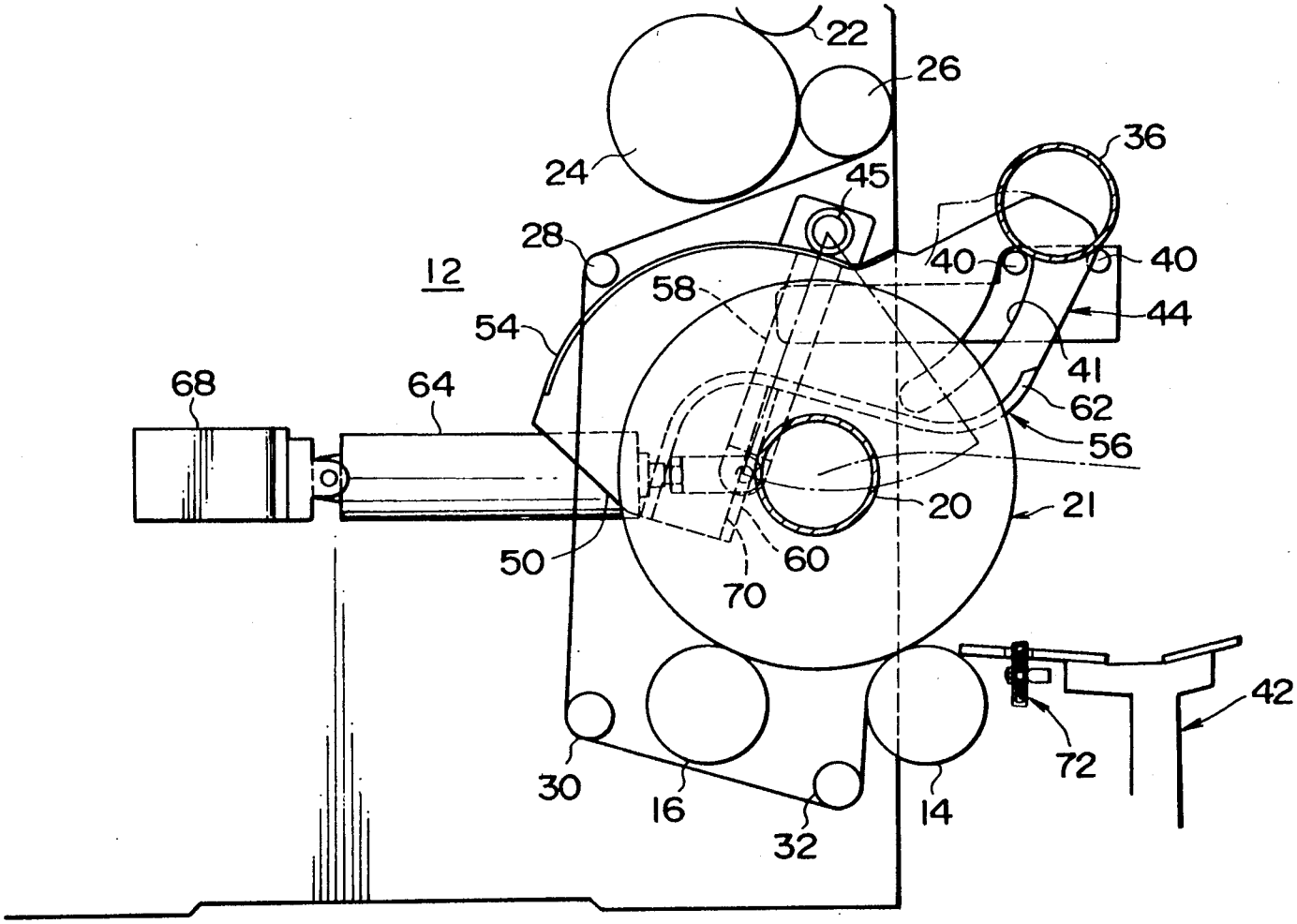
FIG. 8 is a vertical sectional view showing a partially modified cloth roll exchange apparatus under the condition that a full cloth roll is positioned on a pair of rollers as a further preferred embodiment of the present invention.
Figure 9:
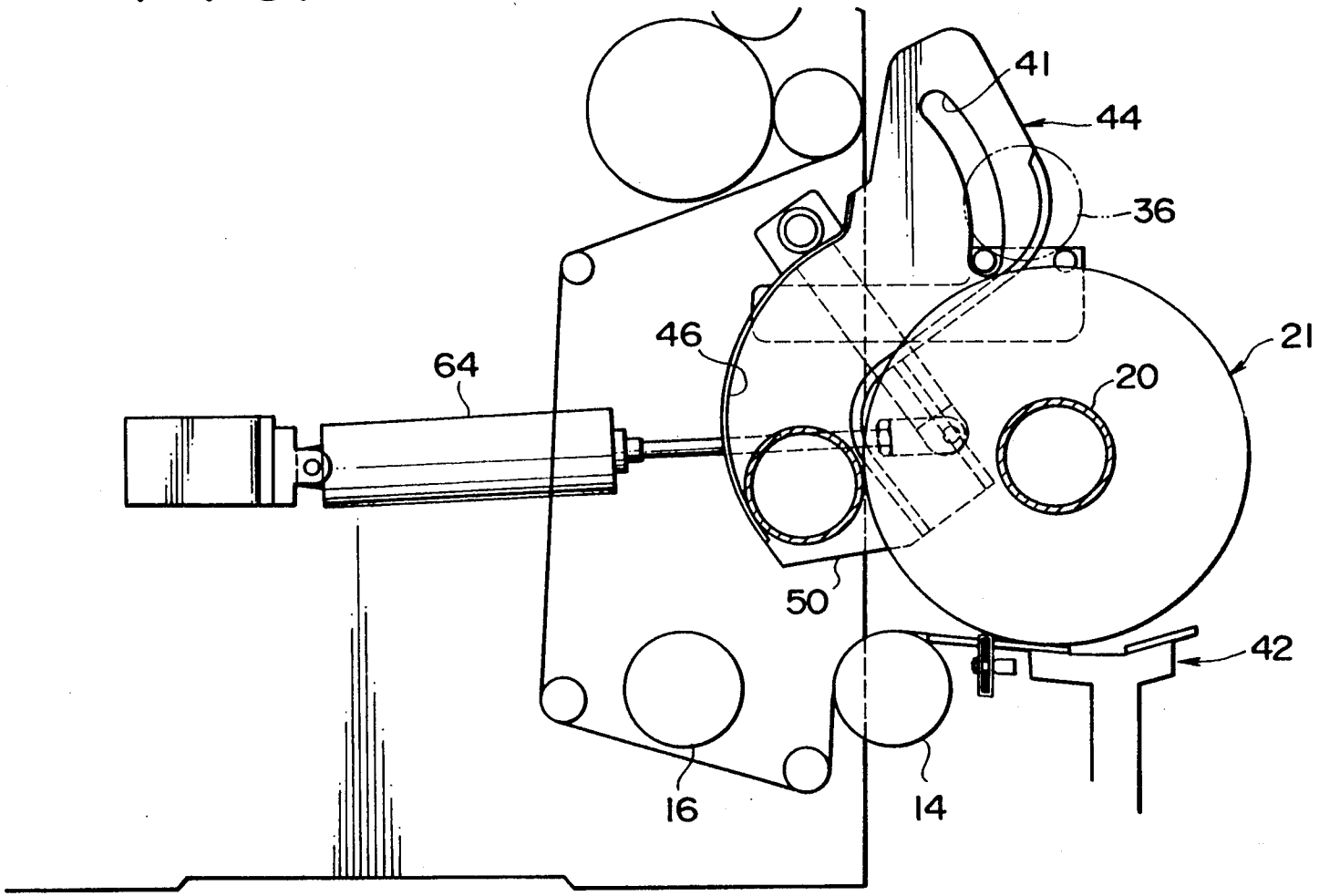
FIG. 9 is a vertical sectional view showing the cloth roll exchange apparatus shown in FIG. 8 immediately before the full cloth roll arrives at the center of a receiving table.
Figure 10:
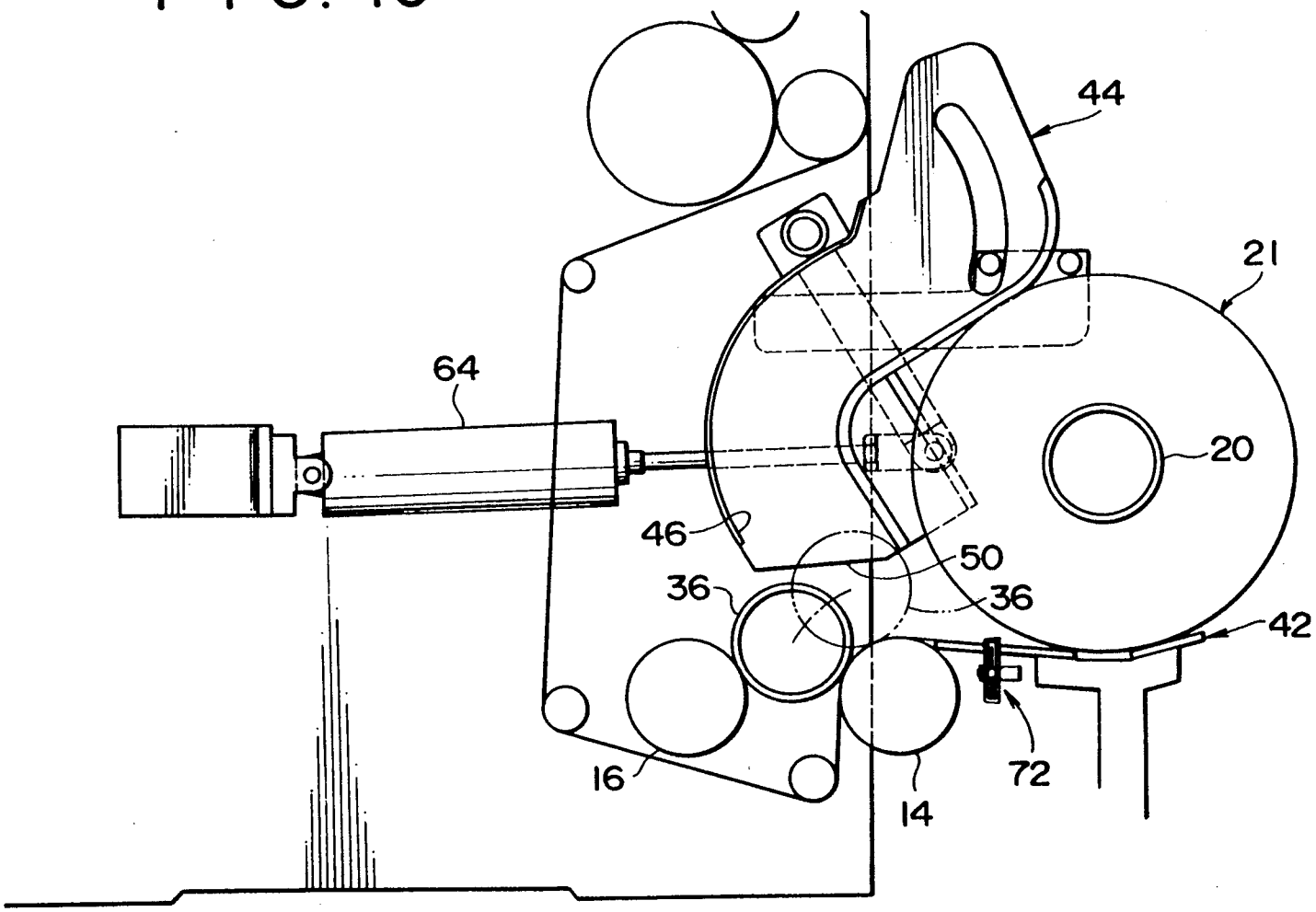
FIG. 10 is a vertical sectional view showing the cloth roll exchange apparatus shown in FIG. 8 under the condition that the full cloth roll arrives at the center of the receiving table.

Now, in an embodiment shown in FIGS. 8 through 10, it is apparent from the comparison between FIG. 2 and FIG. 8 that the oscillating member 44 is preliminarily oscillated clockwise at a slight angle from the condition shown in FIG. 2. Therefore, the front end of the air cylinder 64 and the lever 58 are connected together in closer proximity to the lower end 50 of guide groove 46 and further forward of the lower wall 56, in comparison with the embodiment shown in FIG. 2. The contact portion 60 is mounted further forward and the slot 41 is set to be longer in comparison with the embodiment shown in FIG. 2.

According to this embodiment, the air cylinder 64 is operated to extend so as to oscillate the oscillating member 44 counterclockwise, until the full cloth roll 21 reaches a position just short of being centered on the receiving table 42 (FIG. 9). During this time, the end 36*a* of the empty cloth roll 36 is moved to the right above the lower end 50 of the guide groove 46, and the intermediate portion 36*b* of the empty cloth roll contacts the surface of the textile. Subsequently, the air cylinder 64 is operated to shorten so as to oscillate the oscillating member 44 clockwise. When the lower end 50 of the guide groove 46 is moved to the upper position relative to the front roller 14, the end 36*a* of the empty cloth roll 36 is released from the lower end 50, and the empty cloth roll 36 is dropped onto the roller 14 and rolls down between both rollers 14 and 16.

In this manner, the empty cloth roll 36 is placed on both rollers and the exchange operation for the cloth roll is completed.

Thereafter, a cutter 72 is moved in the axial direction and the textile 18 is cut.

A reference numeral 70 (FIG. 2) indicates a plate portion provided on each oscillating member 44 so as to prevent the full cloth roll 21 from moving in the axial direction during the oscillating movement of the oscillating member 44.

What is claimed is:

1. An apparatus for replacing a full cloth roll loaded on a pair of mutually parallel rollers of a weaving machine and with a textile wound therearound, with an empty cloth roll disposed in an upper position above said full cloth roll, comprising:

a pair of oscillating members supported by said weaving machine to oscillate about an axis of a rod supported by said weaving machine, said axis being parallel to the axes of said pair of rollers; and drive means for having said pair of oscillating members produce oscillating movement;

wherein each oscillating member includes: a contact portion exerting a pressing force to an end portion of said full cloth roll to roll said full cloth roll forward of said weaving machine while both said oscillating members are oscillating in one direction; and a guide wall disposed behind said contact portion for catching said empty cloth roll in cooperation with the peripheral surface of the textile of said full cloth roll, and for directing, during the oscillating movement of both said oscillating members, said empty cloth roll to an upper position right above said pair of rollers in cooperation with the peripheral surface of the textile of said full cloth roll.

2. An apparatus according to claim 1, wherein each said oscillating member further includes a second guide wall disposed in front of said guide wall at a distance greater than an outer diameter of said empty cloth roll, wherein said second guide wall does not contact said empty cloth roll on the pair of rollers when both said oscillating members are oscillating in the other direction.

3. An apparatus according to claim 1, wherein each said oscillating member includes a push-up portion for exerting a push-up force to the end portion of said empty cloth roll disposed in said upper position during the oscillating movement of said oscillating members.

* * * * *